US010959316B2

(12) United States Patent
Park

(10) Patent No.: US 10,959,316 B2
(45) **Date of Patent: *Mar. 23, 2021**

(54) ELECTRONIC LIGHTING APPARATUS WITH WIRELESS CONNECTABILITY TO A BASE FOR WIRELESS POWER TRANSMISSION AND SECURE MOUNTING WITH LOADED SPRING FOR EASY CONNECTION AND RELEASE

(71) Applicant: Ryan Park, Hinsdale, IL (US)

(72) Inventor: Ryan Park, Hinsdale, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/027,053

(22) Filed: Sep. 21, 2020

(65) Prior Publication Data

US 2021/0007207 A1 Jan. 7, 2021

Related U.S. Application Data

(63) Continuation of application No. 16/127,006, filed on Sep. 10, 2018, now Pat. No. 10,785,856.

(51) Int. Cl.

| | |
|---|---|
| ***H01F 27/30*** | (2006.01) |
| ***H05B 47/19*** | (2020.01) |
| ***H01F 27/28*** | (2006.01) |
| ***F21V 21/00*** | (2006.01) |
| ***H01F 38/14*** | (2006.01) |

(52) U.S. Cl.

CPC ..... *H05B 47/19* (2020.01); *F21V 21/00* (2013.01); *H01F 27/2823* (2013.01); *H01F 27/30* (2013.01); *H01F 27/306* (2013.01); *H01F 38/14* (2013.01)

(58) Field of Classification Search

CPC ..... H05B 47/19; H01F 27/30; H01F 38/14; H01F 27/2823; H01F 27/306; F21V 21/00; F21V 21/03; F21V 21/04; F21V 23/06

See application file for complete search history.

(56) References Cited

U.S. PATENT DOCUMENTS

| | | | | |
|---|---|---|---|---|
| 2008/0181426 | A1* | 7/2008 | Hornback ..... | H04R 1/025 381/77 |
| 2010/0141153 | A1* | 6/2010 | Recker ..... | H05B 47/19 315/149 |
| 2012/0293068 | A1 | 11/2012 | Dowdy et al. | |

FOREIGN PATENT DOCUMENTS

| | | | |
|---|---|---|---|
| CN | 205619160 | U | 10/2016 |

* cited by examiner

*Primary Examiner* — Tuyen T Nguyen
(74) *Attorney, Agent, or Firm* — William Park & Associates Ltd.

(57) ABSTRACT

A wireless wiring apparatus includes a ceiling-embedded casing and a power-receiving casing. The ceiling-embedded casing includes screws connected to a surface of the ceiling-embedded casing and configured to be connected to a ceiling, a bracket inside the ceiling-embedded casing and connected to the screws, a coil, and a power wire connected to an external alternating current electrical power source. The power-receiving casing includes neodymium magnets on another surface of the power-receiving case, L-shaped notches formed adjacent to the neodymium magnets, and a coil of wire formed inside the power-receiving casing.

2 Claims, 10 Drawing Sheets

ELECTRONIC LIGHTING APPARATUS WITH WIRELESS CONNECTABILITY TO A BASE FOR WIRELESS POWER TRANSMISSION AND SECURE MOUNTING WITH LOADED SPRING FOR EASY CONNECTION AND RELEASE

BACKGROUND

1. Technical Field

Embodiments of the present disclosure relate generally to a wireless electronic apparatus and more particularly to a wireless lighting apparatus.

2. Related Art

Most large light fixtures, such as chandeliers, require meticulous reconnection of electrical wires in order to connect them to the main power supply. The act of replacing light fixtures can be quite a burden and labor intensive, especially when someone is required to hold a heavy fixture while an electrician connects it to the main power supply. This is on top of needing the skills of an electrician who should understand and know the properties of electricity and the skills of the electrician art to do the job right and safely.

An electrician can take long time to complete the electrical connections of a light fixture to the main source of electrical power. Oftentimes, an individual assisting the electrician must hold the light fixture in place, while the electrician does his or her work of arranging and connecting wires. It is challenging to hold up any light fixture for ten to twenty minutes, no matter the weight of the fixture, as most people's arms get worn out by the act of simply keeping their own arms up in the air for an extended period of time. Even if an elevated surface is used to hold up the fixture instead, the electrician will still require some time and money to complete the installation, which can be inefficient and expensive.

BRIEF DESCRIPTION OF DRAWINGS

Features, aspects, and embodiments are described in conjunction with the attached drawings, in which.

DETAILED DESCRIPTION

Hereinafter, a wireless lighting apparatus according to an embodiment of the present invention will be described below with reference to the accompanying drawings.

Figure 1A:
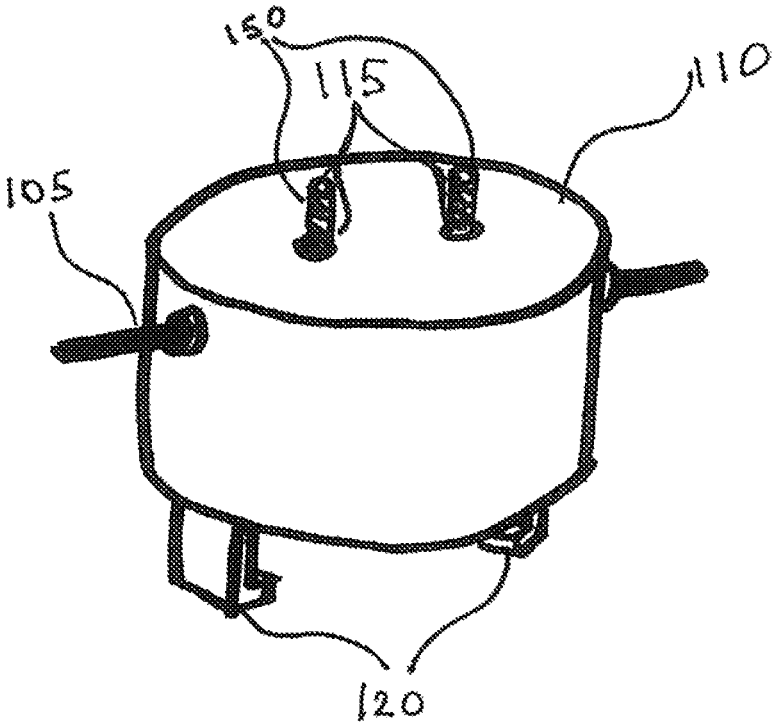
FIGS. 1A-1B show a wireless energy transmitter connected to an external AC power supply and embedded into a ceiling according to an embodiment of the present invention.

Referring to FIG. 1A, there is a ceiling-embedded, cylindrical casing (110) that is connected to an external power supply through an wire (105) with two holes (115) on top surface of the ceiling-embedded cylindrical casing (110) that allow for the casing (110) to be securely screwed into a standard mounting box in a ceiling, for example, via two screws (150). On the lower surface of the ceiling-embedded cylindrical casing (110), two hooks (120) are formed, which will be explained more in detail later, in accordance with an embodiment of the present invention.

Figure 1B:
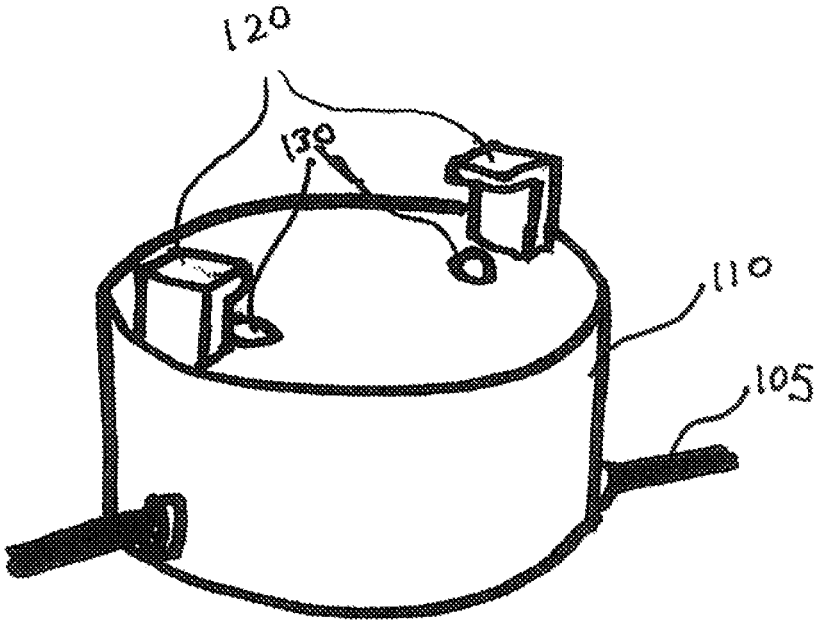

Referring to FIG. 1B, the exterior of the casing (110), which can be formed of plastic or metal or other suitable material, also features two hooks (120) and two neodymium magnets (130) which serve to securely fasten the device in FIG. 2. The ceiling-embedded casing (110) is shown in FIG. 1A-1B as cylindrical in shape; however, various different shapes such as square or oval shapes are also possible. The material for the casing (110) can also be metal or other various other suitable materials such as wood, composites, and many combinations thereof.

Figure 1C:
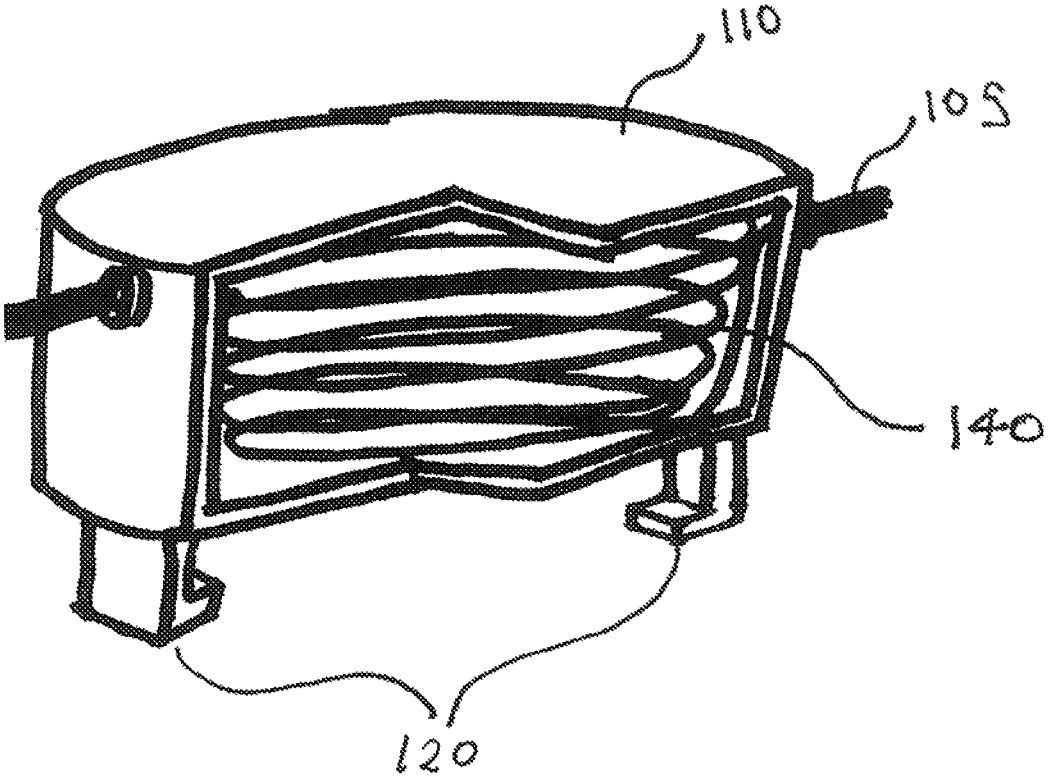
FIG. 1C shows a cutaway of the wireless energy transmitter featured in FIGS. 1A-1B that displays an internal coil of metal wire according to an embodiment of the present invention.

Referring to FIG. 1C, the plastic casing featured in FIGS. 1A-1B contains a coil of wire (140) that is connected to the external power supply (105).

Figure 1D:
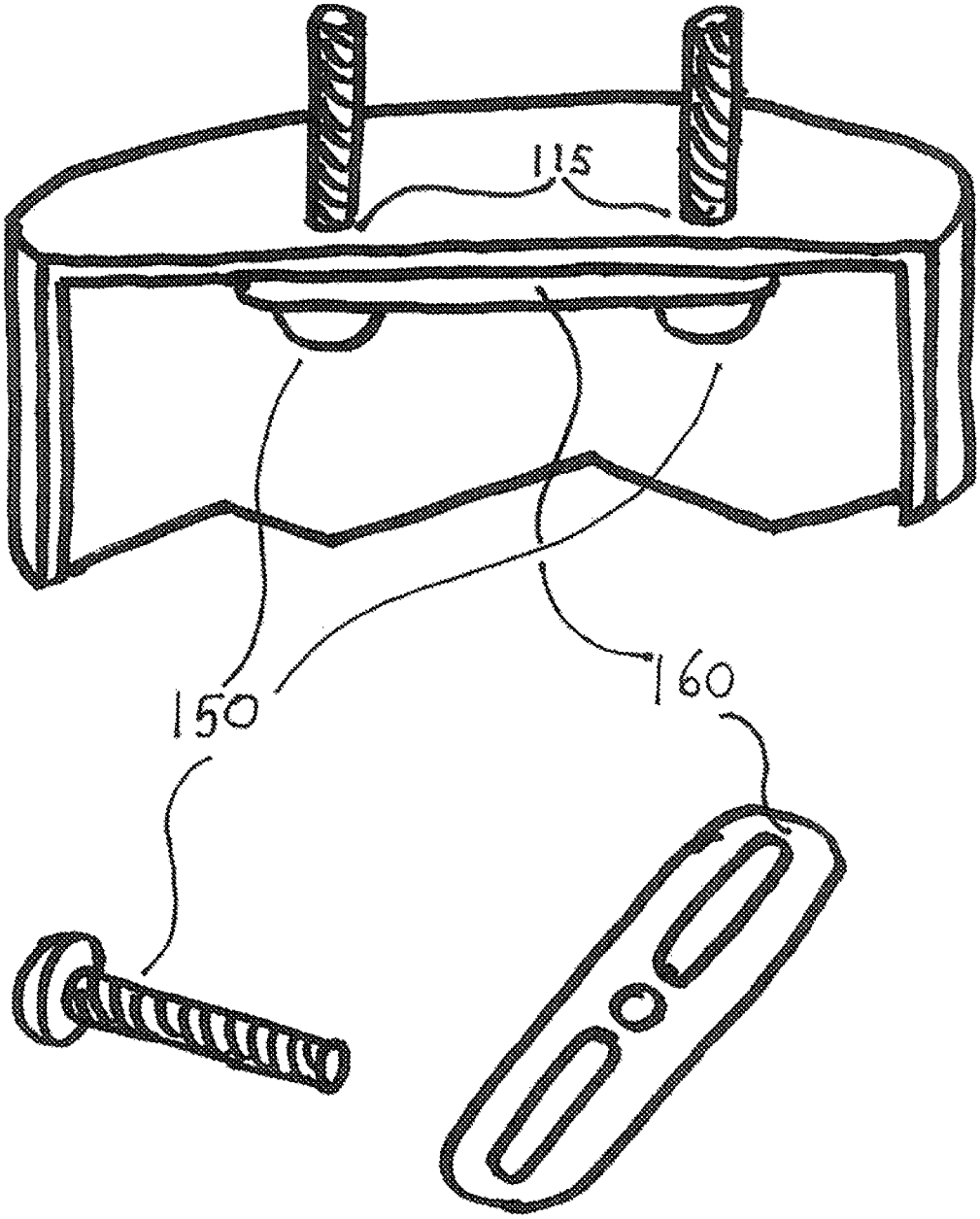
FIG. 1D is a diagram of a cutaway of the same wireless energy transmitter featured in FIGS. 1A-1C showing one example of how the transmitter is fastened to a ceiling according to an embodiment of the present invention.

Referring to FIG. 1D, the plastic casing featured in FIGS. 1A-1C contains two screws (150) protruding from two holes (115) and a metal bracket (160) which serve to fasten the plastic casing to a standard mounting box in a ceiling.

Figure 2A:
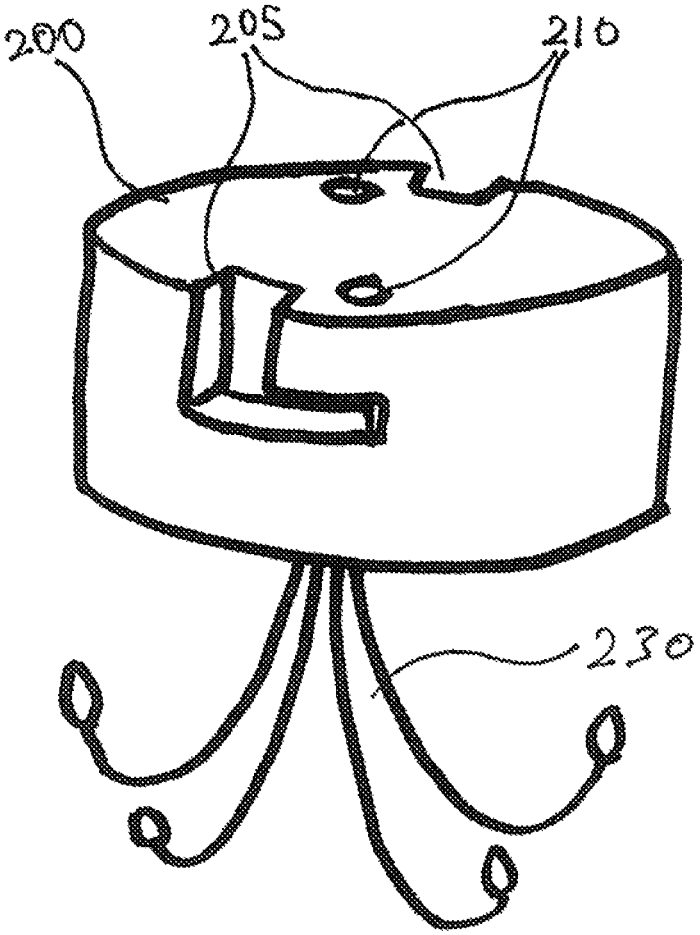
FIG. 2A is a diagram featuring the external case of a wireless energy receiver along with an attached incandescent light fixture according to an embodiment of the present invention.

Referring to FIG. 2A, there are L-shaped notches (205) on the cylindrical plastic casing (200) and neodymium magnets (210) which couple together with the corresponding neodymium magnets and hooks featured in FIG. 1B.

Figure 2B:
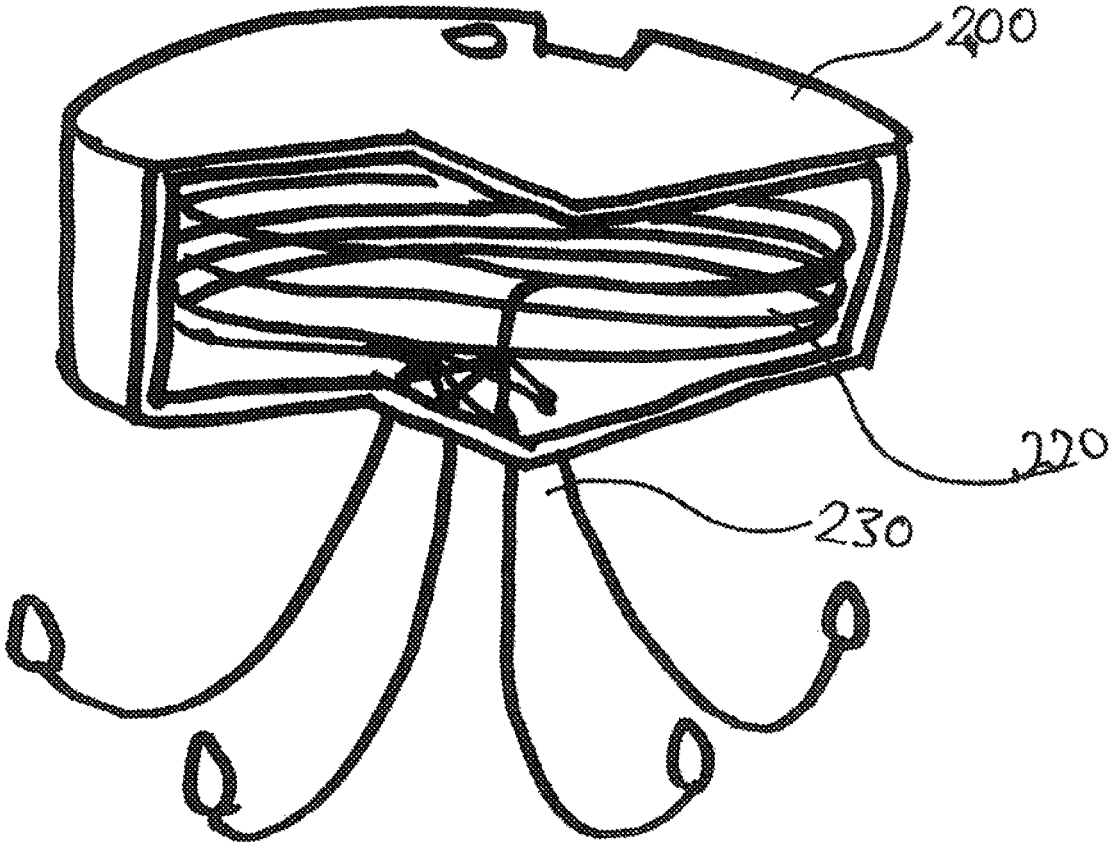
FIG. 2B is a diagram featuring the internals of the same wireless energy receiver featured in FIG. 2A according to an embodiment of the present invention.

Referring to FIG. 2B, the interior of the plastic casing (200) featured in FIG. 2A contains a coil of wire (220), which is connected to electrical wire that extends downward into the light fixture itself (230). The light fixture (230) is merely hypothetical in design.

Figure 2C:
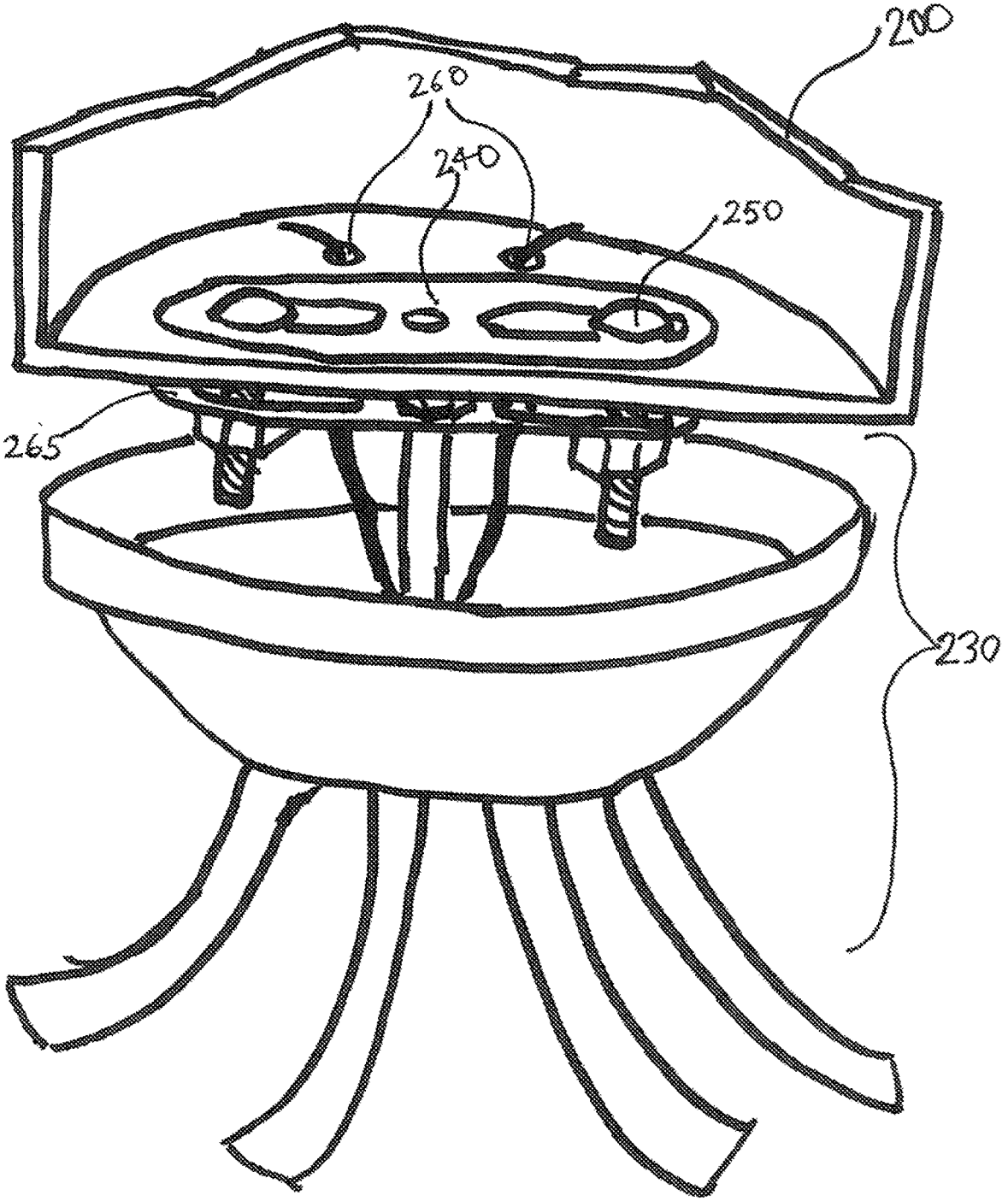
FIG. 2C is a diagram featuring a cutaway of the same wireless receiver in FIGS. 2A-2B that specifies the mechanism to secure light fixtures to the receiver according to an embodiment of the present invention; and, FIGS. 3A-3C are diagrams illustrating a variation of the mechanism featured in FIGS. 1A-1B that securely connects the wireless energy transmitter featured in FIGS. 1A-1D to the wireless energy receiver featured in FIGS. 2A-2C.

Referring to FIG. 2C, the interior of the plastic casing (200) also contains a bracket (240) and two screws (250) that serve to connect to the mounting bracket (265) of a light fixture (270). The interior also features two holes (260) which allow the wires of a light fixture (270) to connect to the coil featured in FIG. 2B. The light fixture (270) is merely hypothetical in design.

When an AC current is flowing through the coil of wire 140 as shown in FIG. 1C, and, when the apparatus featured in FIG. 2B has been fastened to the cylinder in FIG. 1A, a constantly changing magnetic field is generated. The magnetic flux from the coil of FIG. 1C induces an AC current in the coil of FIG. 2B, thus wirelessly transmitting electric energy from the coil of FIG. 1C to the coil of FIG. 2B. This induced current flows through the light fixture (230) and causes it to illuminate.

Figure 3A:
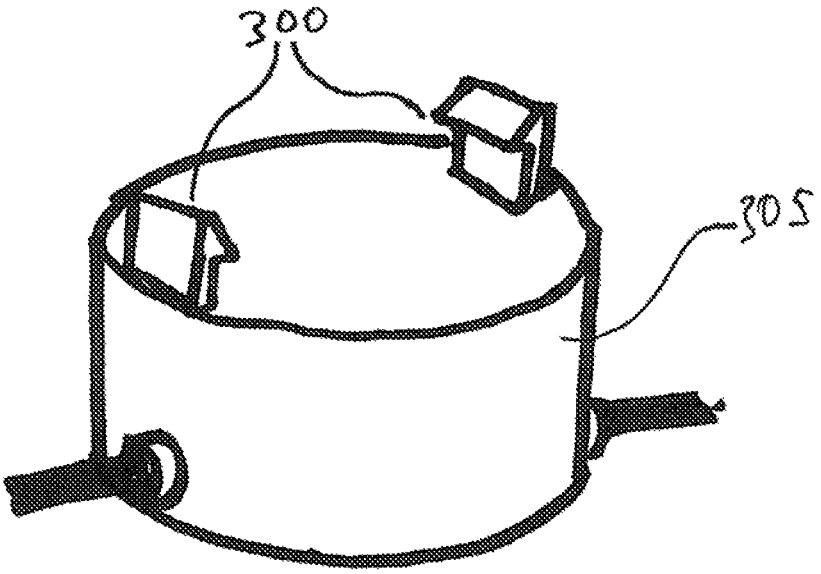

Referring to FIG. 3A, the same plastic casing featured in FIGS. 1A-1C can also feature pointed, triangular plastic hooks (300) instead of the original rectangular hooks (120) and neodymium magnets (130) featured in FIG. 1B.

Figure 3B:
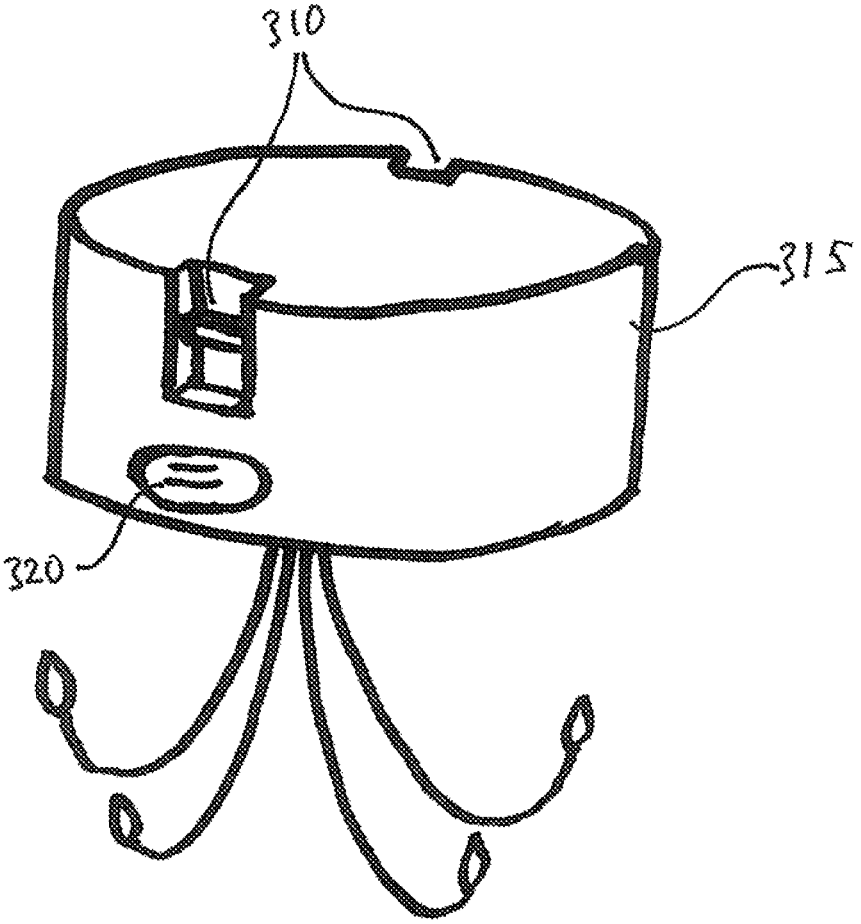

Referring to FIG. 3B, the same plastic casing featured in FIGS. 2A-2C can also feature notches with small protrusions (310) and a button (320) instead of the original L-shaped notches (205) and neodymium magnets (210) featured in FIG. 2A.

Figure 3C:
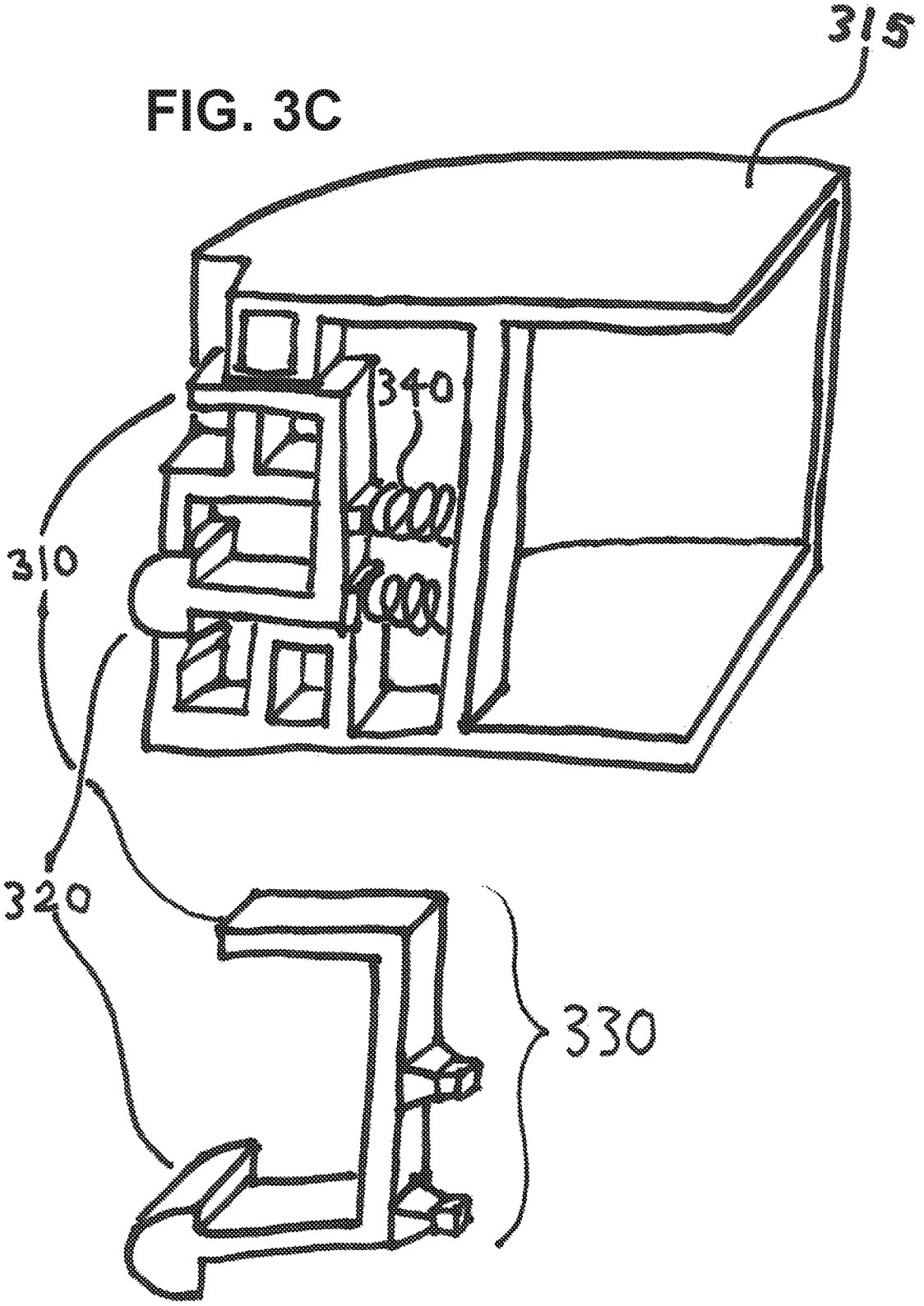

When the hooks in FIG. 3A are slid into the notches of FIG. 3B, the hooks (300) latch onto the protrusions (310) in the notches, causing the casing (305) featured in FIG. 3A to fasten securely to the casing (315) featured in FIG. 3B Referring to FIG. 3C, the same protrusion (310) and button (320) are connected by a single piece (330), located inside the plastic casing (305). This piece is kept in place by two springs (340).

When the button (320) featured in FIGS. 3B and 3C is pressed, the entire piece (330) will slide back against the springs (340). This movement causes the protrusion (310), which is also connected to the piece (330), to retract into the casing (315), which allows the hooks (300) featured in FIG. 3A to unlatch and release after being fastened to the casing (315) featured in FIG. 3B. When pressure is released from the button, the springs (340) will re-expand and push the piece (330) back into its original position, thus resetting the protrusion's (310) original position.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While certain embodiments have been described above, it will be understood to those skilled in the art that the embodiments described are by way of example only. Accordingly, the phase change memory apparatus described herein should not be limited based on the described embodiments. Rather, the phase change memory apparatus described herein should only be limited in light of the claims that follow when taken in conjunction with the above description and accompanying drawings.

What is claimed is:

1. A wireless wiring apparatus comprising:

a ceiling-embedded casing comprising:

a plurality of screws connected to a first surface of the ceiling-embedded casing and configured to be connected to a ceiling;

a bracket positioned inside the ceiling-embedded casing and connected to the screws, wherein the bracket secures the weight load of the ceiling-embedded casing to the ceiling through the screws;

a power wire connected to an external alternating current electrical power source;

a first coil of wire, one end of which is connected to the power wire, wherein the coil of wire is formed inside the ceiling-embedded casing to receive the alternating current electrical power;

a first plurality of neodymium magnets formed on a second surface of the ceiling-embedded casing; and a plurality of hooks formed on the second surface of the ceiling-embedded casing, wherein each hook is positioned adjacent to each neodymium magnet;

a power-receiving casing comprising:

a second plurality of neodymium magnets formed on a first surface of the power-receiving case;

a plurality of notches, each notch comprising a protrusion and a button, each notch of which is formed adjacent to each of the second plurality of neodymium magnets, wherein the notches, each notch comprising protrusion and a button, are configured to receive the plurality of hooks at the top openings of the notches, each notch comprising a protrusion and a button, and mate with the ceiling-embedded casing by rotating the power-receiving casing when the hooks are securely inside the bottoms of the notches, each notch comprising a protrusion and a button;

wherein the number of first plurality of neodymium magnets and the number of second plurality of neodymium magnets are same;

wherein the first and second pluralities of neodymium are aligned to magnetically attract to each other so as to securely attach the power-receiving casing to the ceiling-embedded casing;

wherein the number of hooks and the number of notches are same so as to securely attach the power-receiving casing to the ceiling-embedded casing when the hooks are mated in the notches.

2. The wireless wiring apparatus of claim 1, wherein the protrusion and the button are connected by a piece that is kept in place and in force by a spring, and wherein, when the button is pressed, the notch slides back against the spring such that the protrusion retracts into the casing, which allows the hook to unlatch.

* * * * *